US009850028B2

(12) United States Patent
Huang

(10) Patent No.: US 9,850,028 B2
(45) Date of Patent: Dec. 26, 2017

(54) STACKABLE CONTAINER HAVING OVERHANGING CAP

(71) Applicant: Markwins Beauty Products, Inc., City of Industry, CA (US)

(72) Inventor: Emily Huang, City of Industry, CA (US)

(73) Assignee: Markwins Beauty Products, Inc., City of Industry, CA (US)

( * ) Notice: Subject to any disclaimer, the term of this patent is extended or adjusted under 35 U.S.C. 154(b) by 0 days.

(21) Appl. No.: 15/587,347

(22) Filed: May 4, 2017

(65) Prior Publication Data

US 2017/0320624 A1 Nov. 9, 2017

Related U.S. Application Data

(63) Continuation of application No. 15/151,124, filed on May 10, 2016, which is a continuation of application No. 15/150,153, filed on May 9, 2016.

(51) Int. Cl.
*B65D 21/032* (2006.01)
*B65D 21/02* (2006.01)
(Continued)

(52) U.S. Cl.
CPC ..... *B65D 21/022* (2013.01); *B65D 1/0246* (2013.01); *B65D 41/04* (2013.01)

(58) Field of Classification Search
CPC ..... B65D 21/0222; B65D 21/0217; B65D 21/0219; B65D 21/0223; B65D 1/0246;
(Continued)

(56) References Cited

U.S. PATENT DOCUMENTS

D24,750 S 10/1895 Vail
D81,173 S 3/1930 Thornton
(Continued)

FOREIGN PATENT DOCUMENTS

GB 2506855 A 4/2014
WO 2006061612 A1 6/2006

OTHER PUBLICATIONS

Disney-Pixar Inside Out Lip Balm Set, webpage, http://www.disneystore.com/small-toys-more-toys-disneybullpixar-inside-out-lip-balm-set/mp/1375027/1014307/; 3 pages.
(Continued)

*Primary Examiner* — Stephen Castellano
(74) *Attorney, Agent, or Firm* — Danton K. Mak; Leech Tishman Fuscaldo & Lampl

(57) ABSTRACT

A stackable container, including a body and a cap threadingly engageable with a neck portion of the body and having a vaulted interior and a top portion formed with a frustrum-shaped depression for snap-registered engagement with a base portion of a counterpart of the body, the cap further including handle projections and a skirt. Opposite stop structures prevent rotation of the cap relative to the body beyond predetermined threaded engagement; a detent releasably captures the body in the predetermined threaded engagement. A base portion of the body having inclined side walls facilitates rotation of the body with respect to the cap. The skirt guides the body into alignment with the cap. The base can have four of the side walls forming a square, the containers of a stack having any of four relative orientations. A consumable product such as a cosmetic can extend into the cap from the body.

10 Claims, 5 Drawing Sheets

(51) Int. Cl.
*B65D 41/04* (2006.01)
*B65D 1/02* (2006.01)

(58) Field of Classification Search
CPC ..... B65D 1/023; B65D 1/10; B65D 41/04; B65D 41/02
USPC ..... 206/508; 215/10
See application file for complete search history.

(56) References Cited

U.S. PATENT DOCUMENTS 2,288,349 A * 6/1942 Gibbs ..... B21D 51/44 215/340
3,140,007 A 7/1964 Nettleship
3,369,687 A * 2/1968 Walls ..... B65D 21/0217 206/508
D217,480 S 5/1970 Kohner
3,819,081 A * 6/1974 Runte ..... B01L 9/06 206/446
4,230,232 A * 10/1980 Atkins ..... B65D 41/04 215/330
4,483,450 A 11/1984 Sanchez
D333,976 S 3/1993 Gozzini
D334,139 S 3/1993 Gozzini
D342,018 S 12/1993 Gozzini
D342,019 S 12/1993 Gozzini
D374,395 S 10/1996 Petrucci et al.
D374,396 S 10/1996 Petrucci et al.
D374,617 S 10/1996 Petrucci et al.
D377,757 S 2/1997 Bertolini et al.
D406,053 S 2/1999 Ying
D503,018 S 3/2005 Shih
D503,246 S 3/2005 Shih
D517,418 S 3/2006 Meyer
D517,446 S 3/2006 Thorsteinsson
D520,409 S 5/2006 Thorsteinsson
D534,457 S 1/2007 Newbould et al.
D544,399 S 6/2007 Newbould et al.
D546,061 S 7/2007 Jhuang
D554,432 S 11/2007 Roth et al.
7,726,483 B2 6/2010 Ramanujam et al.
D626,425 S 11/2010 Lam
D705,075 S 5/2014 Zwettler et al.
D726,975 S 4/2015 Kim et al.
D733,967 S 7/2015 Schlatter
9,145,231 B2 9/2015 Furlong
2001/0022304 A1 9/2001 Roche
2006/0072957 A1 4/2006 Wu
2007/0237565 A1 10/2007 Coleman et al.
2014/0069884 A1* 3/2014 Paredes ..... B65D 21/0217 215/10

OTHER PUBLICATIONS

Forever 21 Cat Lip Balm, webpage, http://www.polyvore.com/forever_21_cat_lip_balm/thing?context_id=4130274&context_type=lookbook&id=120759042, 1 page.
Homemade Natural Lip Gloss, webpage, http://ourbestbites.com/2013/01/homemade-natural-lip-gloss/; 19 pages.

* cited by examiner

STACKABLE CONTAINER HAVING OVERHANGING CAP

CROSS REFERENCE TO RELATED APPLICATIONS

This application is a continuation of U.S. patent application Ser. No. 15/151,124 titled "Stackable Container Having Overhanging Cap" filed May 10, 2016, now abandoned, which is a continuation of U.S. patent application Ser. No. 15/150,153 titled "Stackable Container Having Overhanging Cap," filed on May 9, 2016, the contents of which are incorporated herein by reference in their entirety.

BACKGROUND

The present invention relates to storage containers, and more particularly to those that are stackable. Such containers typically have a body forming a storage cavity and a detachable lid that either snaps on or is threaded onto the body. The lid is formed for releasably receiving a bottom portion of the body so that any number of the containers can be stacked with their lids attached. One problem with such containers having snap-on lids, whether stackable or not, is that the lid is either difficult to remove for access to the storage cavity or else it becomes detached too easily. Conversely, threaded lids are often extremely difficult to remove, particularly in case the threads become contaminated. Another problem is that proper threaded engagement is often difficult to obtain, resulting in cross-threading, which can permanently damage the threads.

One class of containers, for consumable products such as lip balm or lipstick, has the product projecting from the body into the lid. These are typically relatively small and not generally stackable, the lids or caps thereof closely fitting the product and being a push-fit onto the body. A disadvantage of this configuration is that the outside of the body is easily contaminated by the product after only a few applications.

Lipstick and/or lip balm is carried and/or stored in plural varieties, such as color and/or flavor. Accordingly, it would be desirable to have means for releasably joining plural counterparts of even very small containers.

Another class of containers is characterized by decorative features such as animal characters. However, containers having stackable configurations are generally less suitable for providing robust decorations, especially when it is desired to be able to turn such decorations relative to the base.

Thus, there is a need for a container configuration that overcomes at least some of the above difficulties and disadvantages of the prior art.

SUMMARY

The present invention meets this need by providing a stackable container having a threaded cap that is easily engaged without cross-threading. In one aspect of the invention, the container includes a body forming a storage cavity and including a base portion, a barrel portion, and a threaded neck portion that extends from a shoulder surface of the barrel portion; a cap formed for threaded engagement with the neck portion and having a vaulted interior forming a cap clearance surface, and a top portion formed with a frustrum-shaped depression for registered engagement with the base portion of a counterpart of the body; and a stop structure for preventing rotation of the cap relative to the body beyond a predetermined threaded engagement. Herein, "threaded" means having a helical or spiral ridge, and "threaded engagement" means coaxial advancement produced by continued rotation of the cap relative to the body. The base portion forms a generally frustrum-shaped surface for facilitating rotation of the body relative to the cap, the base portion having a floor wall and side walls that extend upwardly and outwardly from the floor wall, joining the barrel portion. A body projection extends outwardly from each of the side walls generally in horizontal alignment with the floor wall.

The cap also includes oppositely disposed handle projections for facilitating manipulation of the cap, a skirt portion that extends substantially below the neck portion of the body when the cap is threaded onto the body for facilitating alignment of the body with the cap. More particularly, the skirt portion extends downwardly a distance greater than the length of the neck portion, closely clearing the body for guiding the body toward the threaded engagement. Also, a pair of inwardly extending cap projections near opposite sides of the depression provide snap engagement with a selected corresponding pair of body projections of a counterpart of the base being stacked on the cap.

The stop structure includes at least one body stop boss that is formed on the body for preventing excessive threaded tightening of the cap onto the body by abutting engagement with a cap stop boss of the cap as the threaded neck portion of the body reaches fully threaded engagement with a complementary threaded portion of the cap. The abutting engagement prevents a barrel shoulder of the body from contacting the cap stop boss. Further, the body stop boss has detentable engagement with a detent projection of the cap. Preferably there are oppositely disposed first and second stop structures for balanced and more robust stop action within a given axial space allotment.

The base can have four of the side walls. Preferably a circular body clearance surface diameter at a lower extremity of the skirt portion has a radial clearance from the body of not more than 2.5 percent of a body outside diameter of the barrel portion of the body when the cap is in threaded engagement with the body. More preferably, the radial clearance is between 1 percent and 2 percent of the body outside diameter. Also, the cap preferably includes a plurality of foot projections that downwardly extend from the skirt portion for supporting the cap with enhanced stability when the cap is detached from the body.

Preferably, a main portion of the cap is formed as an ellipsoidal shape having a length, width, and height, the length being at least 15 percent greater than the width. Preferably, the width is at least 50 percent greater than an outside diameter of the body.

A consumable product such as a cosmetic can be attached within the body and extending outside of the neck portion of the body and into the cap when the cap is threaded onto the body.

DRAWINGS

These and other features, aspects, and advantages of the present invention will become better understood with reference to the following description, appended claims, and accompanying drawings, where:

DESCRIPTION

Figure 2:
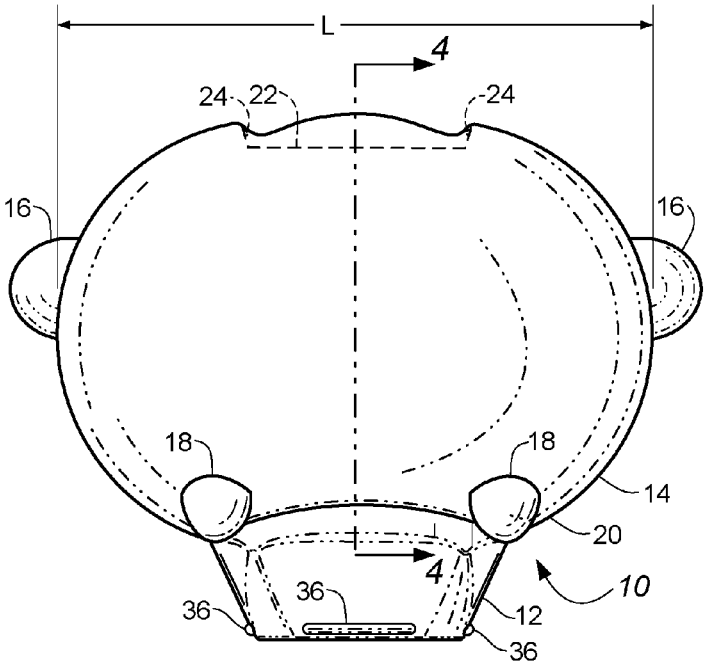
FIG. 2 is a side elevational view of the container of FIG. 1.
Figure 1:
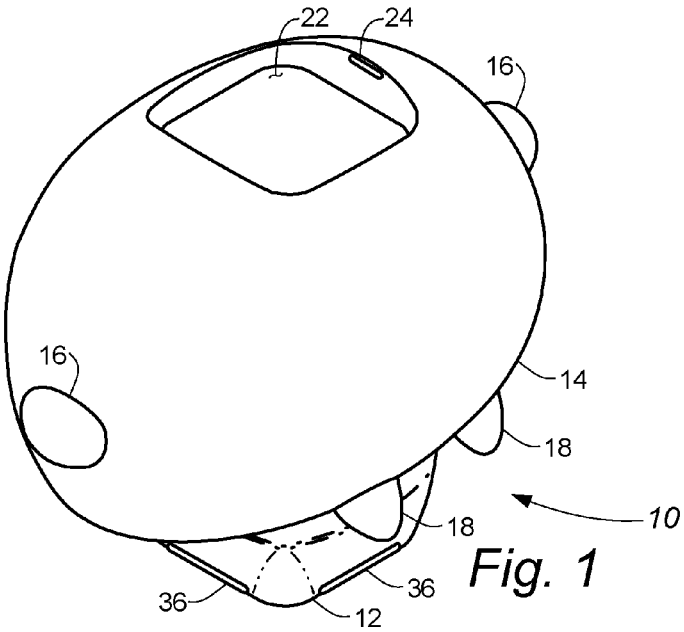
FIG. 1 is an elevational perspective view of a stackable container according to the present invention.
Figure 4:
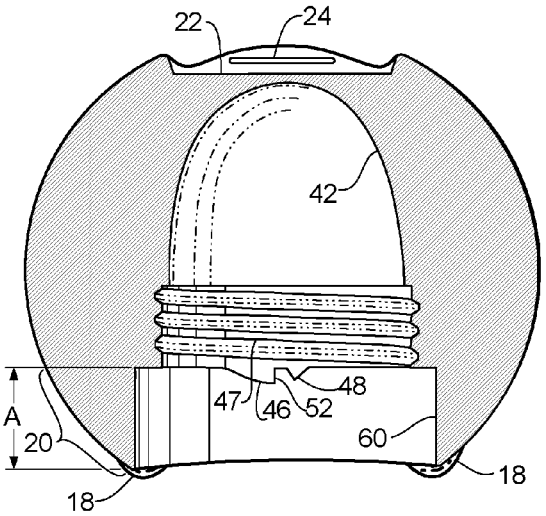
FIG. 4 is a sectional elevational view of a cap portion of the container of FIG. 1 on line 4-4 in FIG. 2.

The present invention is directed to a container having a threaded cap that is particularly easy to put fully on and remove, the container being preferably stackable with individual ones of the containers being selectively oriented. With reference to FIGS. 1-13 of the drawings, an exemplary container 10 according to the present invention includes a body 12 and a threadingly connectible cap 14, the cap being generally of enlarged ellipsoidal shape of length L, width W, and height H. An oppositely disposed pair of enlargements or handles 16 project from the main ellipsoidal shape of the cap, the length L being exclusive of the handles. Also, a plurality (in this case four) of feet 18 project downwardly from an apron portion or skirt 20 of the cap 14 that extends downwardly a distance A about the body 12 as further described below. A depression 22 is formed at the top of the cap 14 for receiving the bottom portion of a counterpart of the body 12. Opposite upper extremities of the depression 22 have inwardly oriented cap projections 24 for releasably holding the counterpart body as further described below.

Figure 6:
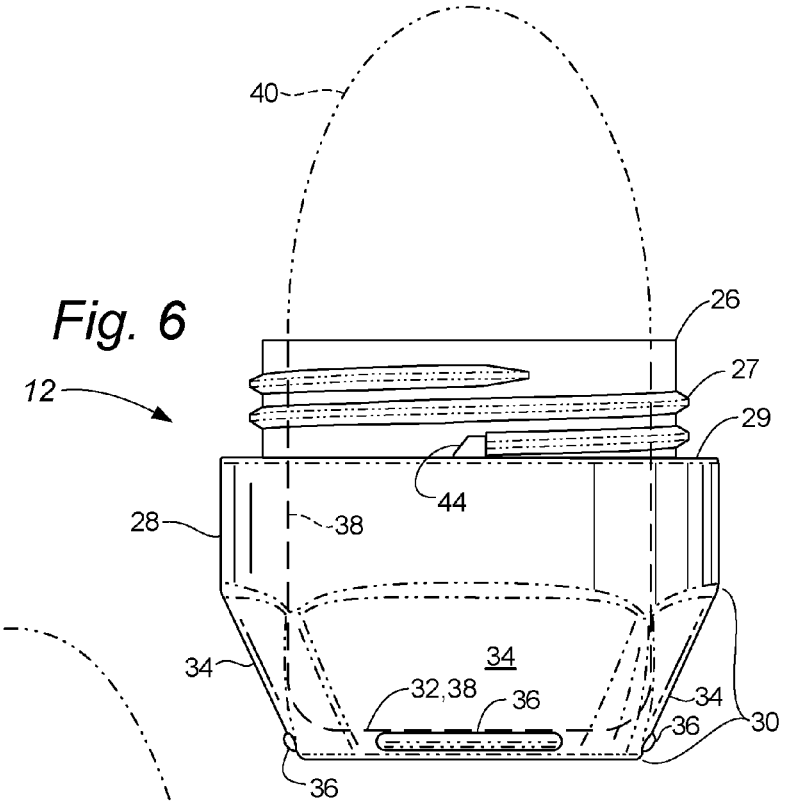
FIG. 6 is a front elevational view of the body portion of FIG. 5.
Figure 7:
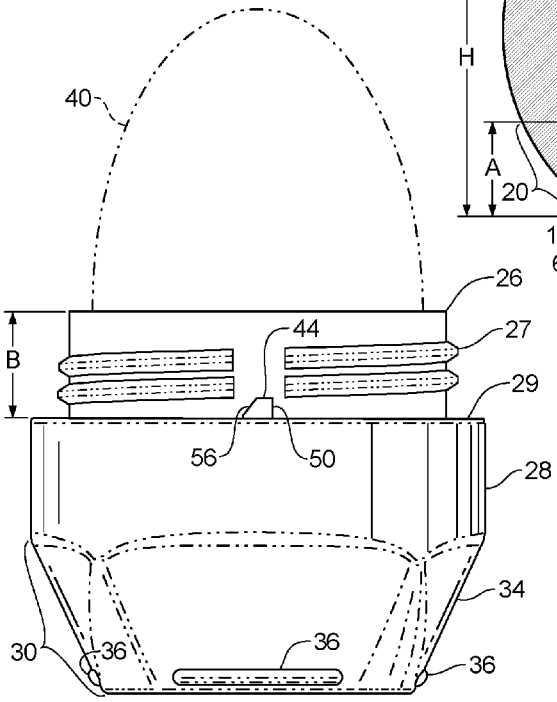
FIG. 7 is a rear elevational view of the body portion of FIG. 5.

As best shown in FIGS. 5-8, the body 12 is formed including a threaded neck portion 26 having an integrally formed neck thread 27, a cylindrical barrel portion 28, and a base portion 30 that includes a floor wall 32 and outwardly and upwardly extending side walls 34. The neck portion 26 extends axially above the barrel portion by a neck length B as shown in FIG. 7. The base portion 30 is configured for registered engagement with the depression 22 that is formed in the cap 14 as described above, at least one pair of base projections 36 extending oppositely outwardly from the floor wall 32, i.e, proximate bottom extremities of respective side walls 34 for snap engagement with the cap projections 24 that extend into the depression 22 as described above. It will be understood that the side walls 34 can be considered to be overlapping outer extremities of the floor wall 32, the base projections in the exemplary configuration being generally horizontally aligned with the floor wall.

In the exemplary configuration of the container 10 described herein, the floor wall 32 is generally square, there being four of the side walls 34, each of the side walls having a counterpart of the base projection 36. Thus in this exemplary configuration the body 12 can selectively have snap engagement with the cap in any of four orthogonal orientations. It will be understood that other preferably regular polygonal shapes of the base portion are possible with suitably configured forms of the cap depression 22. Actually, configurations having an odd number of polygonal sides of the base portion 30 are possible, preferably also incorporating an odd plurality of the cap projections 24.

Figure 5:
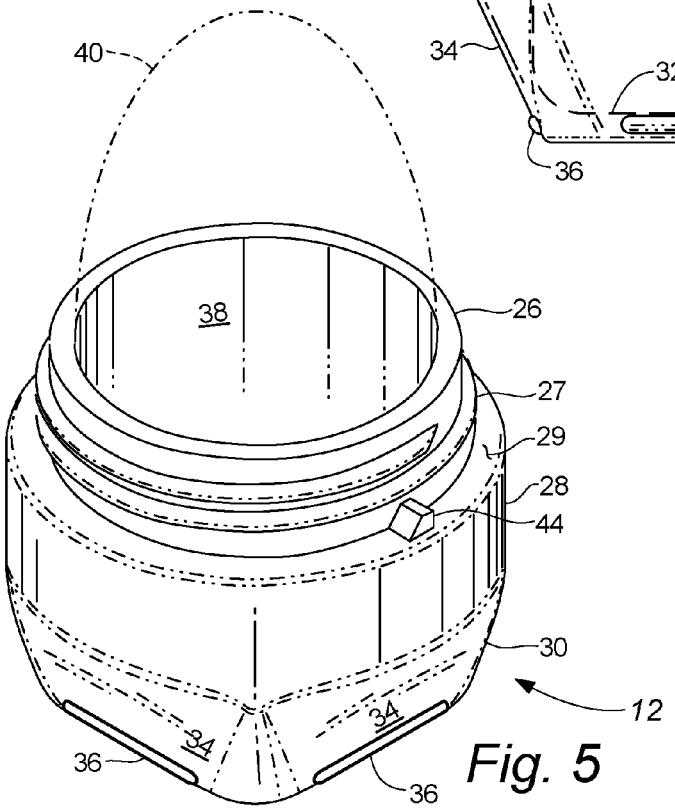
FIG. 5 is an elevational perspective view of a body portion of the container of FIG. 1.
Figure 8:
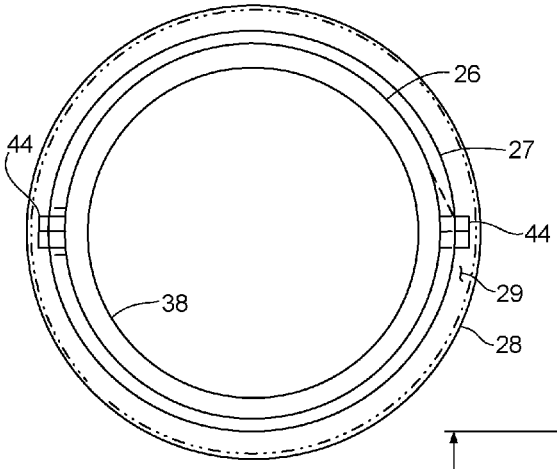
FIG. 8 is a top plan view of the body portion of FIG. 5.

The body 12 is hollow, having an interior body cavity 38 for receiving at least a portion of an object 40 or objects to be stored. Preferably, the object 40 can project above the body 12 as shown in FIGS. 5 and 6, the cap 14 having a vaulted interior object clearance surface 42 for clearing the object 40. In some applications of the present invention, the object can be a consumable product such as lipstick or lip balm, in which case the product would typically completely fill the body cavity 38, being preferably bonded thereto, useable portions of the product extending above the body as shown and described above.

Figure 10:
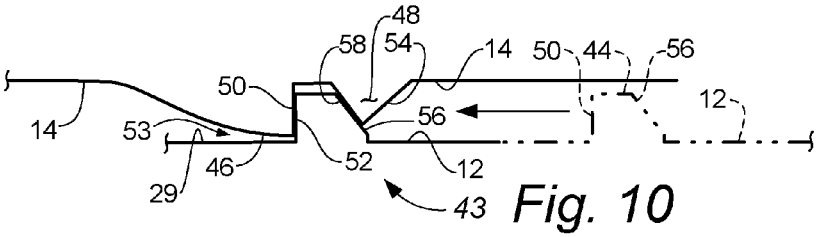
FIG. 10 is a detail view showing a stop and detent structure of the container of FIG. 1.
Figure 3:
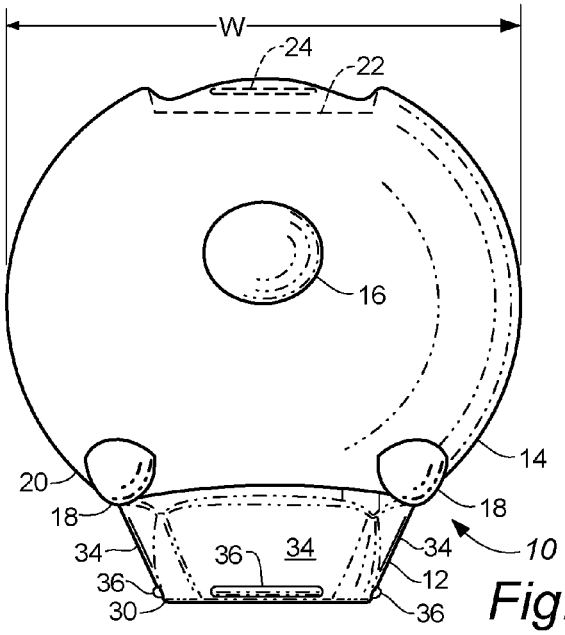
FIG. 3 is an end elevational view of the container of FIG. 1.
Figure 9:
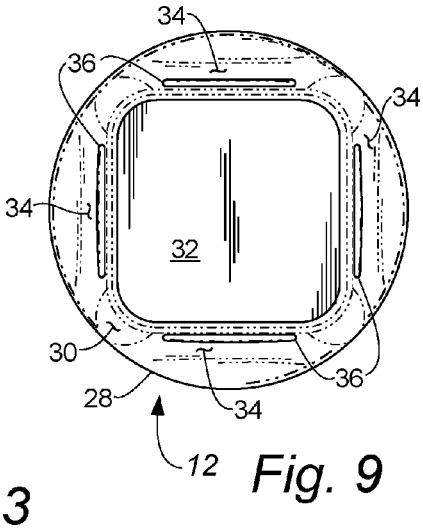
FIG. 9 is a bottom view of the body portion of FIG. 5.

As further shown in FIGS. 4-10, the container 10 is preferably provided with a stop structure 43 that includes at least one body stop boss 44 that is formed on the body 12 for preventing excessive threaded tightening of the cap 14 onto the body 12 by abutting engagement with a cap stop boss 46 of the cap 14 as the threaded neck portion 26 of the body reaches fully threaded engagement with a complementary threaded portion 47 of the cap 14. It is further preferred that the boss 44 have detentable engagement with a detent projection 48 of the cap 14 as described herein. More particularly, the body stop boss 44 is formed having a generally radially and axially extending body stop surface 50 that comes into abutting contact with a cap stop surface 52 of the cap stop boss 46 as best shown in FIG. 10, wherein broken lines represent the body stop boss 44 approaching the cap stop boss 46 in the direction of the arrow, solid lines representing full detented engagement. It is preferred that the above-described abutting contact avoids contact between the shoulder 29 of the barrel portion 28 and the cap 14, as further shown in FIG. 10 as a gap 53 between the shoulder 29 and the cap boss 46. The detent projection 48 has an inclined first detent ramp surface 54 that is slidingly engaged by the boss 44, the parts being momentarily slightly pried apart vertically as the boss approaches the full detented engagement. Also, a contact inclined boss ramp surface 56 is formed on the boss 44 opposite the body stop surface 50 for snap engagement with an inclined second detent ramp surface 58 of the detent projection 48 of the cap 14. Thus the present invention facilitates assembly of the body 12 with the cap 14 in a releasably fixed relative orientation at full threaded engagement while additionally permitting other angular orientations between them.

Figure 11:
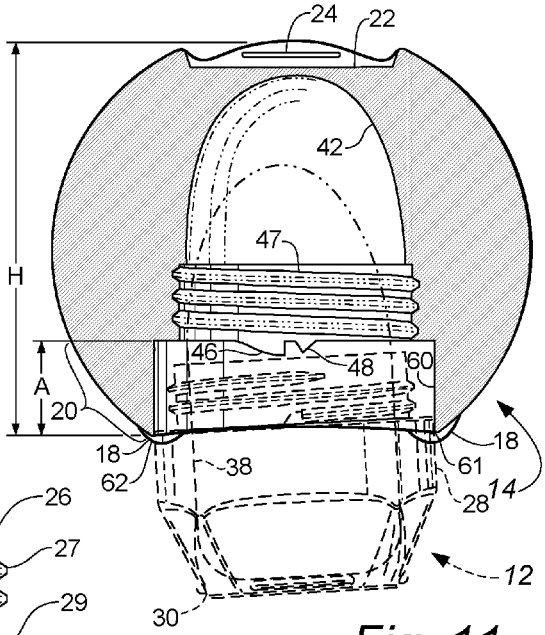
FIG. 11 is a fragmentary sectional detail view showing the body being positioned for threaded engagement with the cap.

As further shown in FIG. 11, the inside of the skirt portion 20 of the cap 14 forms a body clearance surface 60 for guiding the body 12 into alignment with the cap. The body is shown tilted out of alignment as the barrel portion 28 makes contact with bottom extremities of the skirt portion 20 as indicated at respective contact points 61 and 62. As the body is moved upwardly into the cap, concentric alignment is achieved prior to the threaded engagement according to the present invention.

Figure 12:
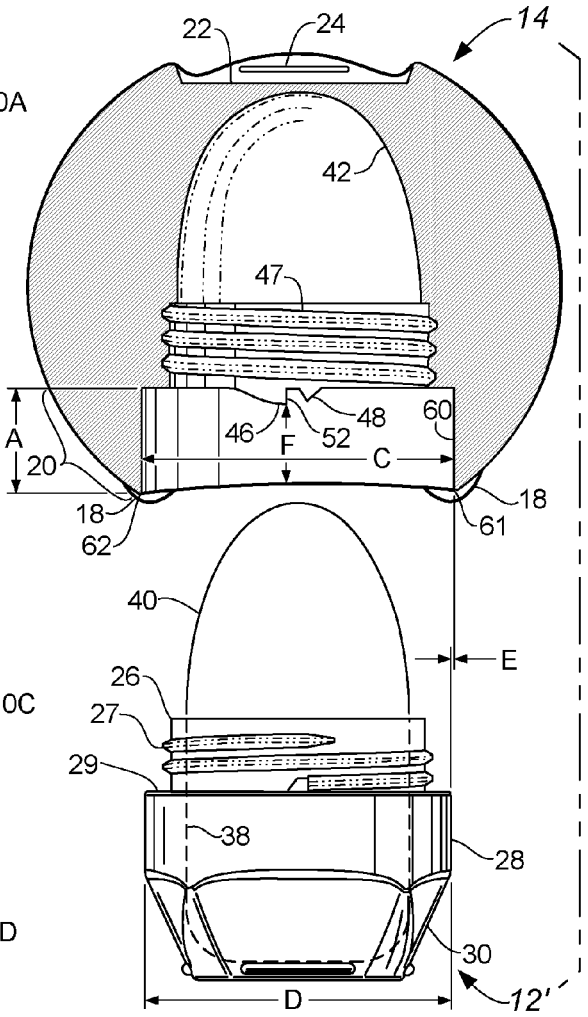
FIG. 12 is a sectional elevational view showing the stackable container of FIG. 1 with the cap spaced from and in coaxial alignment with the body.

FIG. 12 shows the body 12 in concentric relation with the cap 14, the clearance surface 60 of the cap 14 having a body clearance diameter C, and the barrel portion 28 of the body 12 having a body outside diameter D, with a resultant nominal radial clearance E between the barrel portion 28 and the skirt portion 20, the skirt portion extending at least an axial skirt projection distance F below the cap stop boss 46. It will be understood that the barrel portion 28 need not be strictly circular, the body outside diameter being that which no part of the body 12 that will enter the skirt portion 20 projects beyond, the body being formed congruent with the body clearance diameter C sufficiently for the guiding into alignment described above in connection with FIG. 11.

In one exemplary configuration of the stackable container 10 wherein the object 40 is a cosmetic product, the body outside diameter D is approximately 1.12 inch (27.5 mm), and the body clearance diameter C is approximately 1.16 inch (29.5 mm), the radial clearance E being nominally 0.02 inch (0.5 mm) and corresponding to 1.72 percent of the body outside diameter D. It is preferred that at this scale the radial clearance E be not less than 0.01 inch (0.25 mm), which corresponds to not less than 0.86 percent of the body clearance diameter C. More generally, it is preferred that the radial clearance E be not more than 2 percent of the body outside diameter D, more preferably, not more than 1 percent. Neither the body clearance surface 60 nor the outside of the body 12 such as at the contact points 61 and 62 need be strictly circular to achieve the above-described guiding into the threaded engagement, although such is preferred.

In the above example, the length L of the cap 14 is approximately 2.2 inch (56 mm), the cap width W is approximately 1.85 inch (47 mm), and the height H is approximately 1.7 inch (43 mm). Thus in this example the length is 2.2/1.85×100 or approximately 19 percent greater than the width. It is preferred that the length L be at least 15 percent greater than the width W for facilitating manipulation of the cap 14, and for enhanced visual impact when plural containers 10 are stacked in various orientations. Further, the length L is 2.2/1.12×100 or approximately 100 percent greater than the body outside diameter D, it being preferred that the length L be at least 90 percent greater than the body outside diameter D. Also, the width W is 1.85/1.12×100 or approximately 154 percent greater than the body outside diameter D, it being preferred that the width W be at least 50 percent greater than the diameter D.

Figure 13:
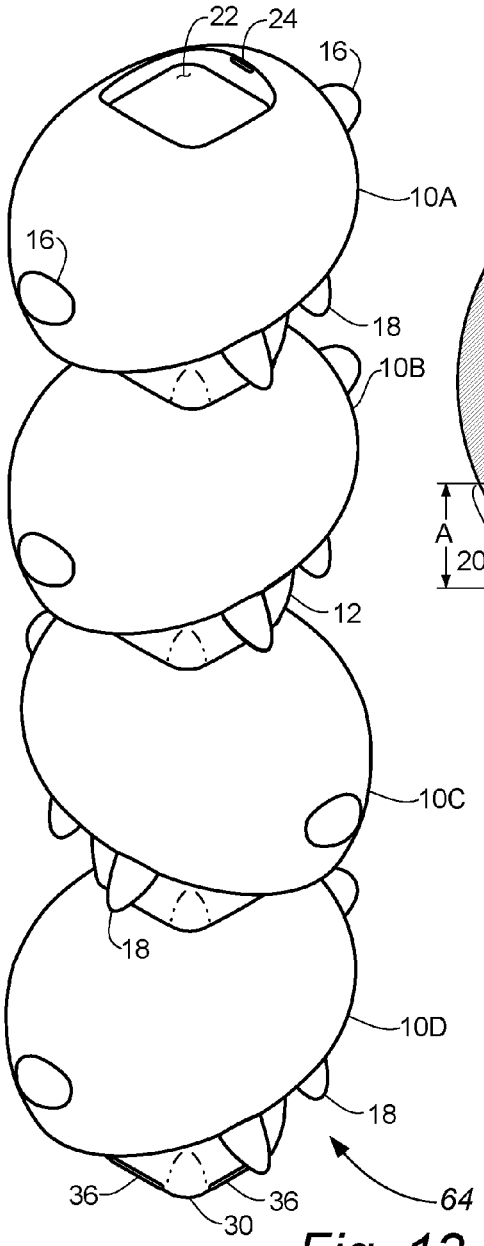
FIG. 13 is an elevational perspective view showing a stack of the containers of FIG. 1.

FIG. 13 shows a container stack 64 including four of the containers, the containers being individually designated 10A, 10B, 10C, and 10D, the container 10C being rotated 90 degrees relative to the containers 10A, 10B, and 10D. It will be understood that in addition to the various orientations permitted of individual ones of the containers 10 of the container stack 64 when each of the caps 14 are detented in the fully threaded condition on respective ones of the bodies 12, any number of the caps 14 can be rotated out of respective detented conditions relative to a corresponding body 12 while maintaining an effective degree of threaded engagement. It will be further understood that in the case of the generally square base configuration shown in the drawings, any desired relative angular orientation of particular ones of the caps 14 of the container stack 64 is permitted without moving any of the caps 14 relative to its body 12 as much as 90 degrees. Moreover, should a body 12 have a discernable orientation such as by having unique artwork on a particular side wall 34, its cap 14 can be rotated to any desired relative orientation in threaded engagement, provided the detented threaded engagement is greater than one revolution. In the exemplary configuration shown in the drawings, the detented engagement is in excess of one revolution.

Although the present invention has been described in considerable detail with reference to certain preferred versions thereof, other versions are possible. For example, the cap 14 can have a decorative shape simulating an animal face and/or body character, the handle portions 16 simulating ears and/or a nose and a tail, and the feet 18 simulating legs. Therefore, the spirit and scope of the appended claims should not necessarily be limited to the description of the preferred versions contained herein.

What is claimed is:

1. A stackable container, comprising:

(a) a body forming a storage cavity and including a base portion, a barrel portion and a threaded neck portion, the neck portion extending from a barrel shoulder surface;

(i) the base portion having a floor wall and a plurality of side walls, the side walls extending upwardly and outwardly from the floor wall and joining the barrel portion; and (ii) a body projection extending outwardly from each of the side walls generally in horizontal alignment with the floor wall;

(b) a cap formed for threaded engagement with the neck portion and having a vaulted interior forming a cap clearance surface, and a top portion formed with a frustrum-shaped depression for registered engagement with the base portion of a counterpart of the body, the cap further comprising:

(i) an oppositely disposed pair of handle projections;

(ii) a skirt portion projecting in close proximity with the barrel portion of the body when the body is threadingly engaged with the cap, the skirt portion extending downwardly a distance greater than an axial length of the neck portion of the body for facilitating alignment of the body with the cap as the body is positioned for the threaded engagement; and (iii) a pair of inwardly extending cap projections located proximate opposite sides of the depression for snap engagement with a selected corresponding pair of the body projections of a counterpart of the base portion; and (c) a stop structure for preventing rotation of the cap relative to the body beyond a predetermined threaded engagement, comprising:

(i) a body stop boss formed on the body and having a radially and vertically oriented stop surface formed thereon;

(ii) a cap stop boss formed in the cap and having a radially and vertically oriented cap stop surface formed thereon, the respective bosses preventing excessive threaded tightening of the cap onto the body by abutting engagement as the threaded neck portion of the body reaches fully threaded engagement with a complementary threaded portion of the cap, the abutting engagement preventing contact between the barrel shoulder surface and the cap stop boss; and (iii) a detent projection formed in the cap for releasably capturing the body stop boss when the respective bosses reach the abutting engagement, wherein the base portion forms a generally frustrum-shaped surface for facilitating rotation of the body with respect to the cap.

2. The stackable container of claim 1, wherein the stop structure is a first stop structure, the container further comprising a corresponding second stop structure opposite the first stop structure.

3. The stackable container of claim 1, wherein the base portion of the body has four of the side walls.

4. The stackable container of claim 1 wherein the barrel portion of the body has a body outside diameter, the cap clearance surface at a lower extremity of the skirt portion being circular and having a body clearance diameter and, when the cap is in threaded engagement with the body, the body clearance surface has a radial clearance from the body of not more than 2.5 percent of the body outside diameter.

5. The stackable container of claim 4, wherein the radial clearance is between 1 percent and 2 percent of the body outside diameter.

6. The stackable container of claim 1, wherein the cap further comprises a plurality of downwardly projecting foot projections for supporting the cap when the cap is detached from the body.

7. The stackable container of claim 1, wherein a main portion of the cap is formed as an ellipsoidal shape having a length, width, and height, the length being at least 15 percent greater than the width.

8. The stackable container of claim 7, wherein the width is at least 50 percent greater than an outside diameter of the body.

9. The stackable container of claim 1, further comprising a consumable product attached within the body and extending outside of the neck portion of the body and into the cap when the cap is threaded onto the body.

10. The stackable container of claim 9, wherein the consumable product is a cosmetic.

* * * * *